United States Patent [19]

Kamp et al.

[11] 4,314,439

[45] Feb. 9, 1982

[54] DEVICE FOR CHARGING A TEXTILE MACHINE WITH COIL TUBES

[75] Inventors: Heinz Kamp, Wegberg; Rolf Becker; Manfred Stops, both of Mönchen-Gladbach, all of Fed. Rep. of Germany

[73] Assignee: W. Schlafhorst & Co., Mönchen-Gladbach, Fed. Rep. of Germany

[21] Appl. No.: 105,959

[22] Filed: Dec. 21, 1979

[30] Foreign Application Priority Data

Dec. 23, 1978 [DE] Fed. Rep. of Germany ..... 2856027

[51] Int. Cl.[3] ..... D01H 9/00; D01H 9/10

[52] U.S. Cl. ..... 57/270; 57/271

[58] Field of Search ..... 57/270, 271, 268, 269

[56] References Cited

U.S. PATENT DOCUMENTS 3,164,946 1/1965 Du Buis et al. ..... 57/270

3,298,166 1/1967 Banks et al. ..... 57/270

3,328,948 7/1967 Du Buis et al. ..... 57/270

3,344,594 10/1967 Takemura et al. ..... 57/270

*Primary Examiner*—John Petrakes

*Attorney, Agent, or Firm*—Herbert L. Lerner

[57] ABSTRACT

Device for loading a textile machine with individual conical coil tubes, including a supply container for the individual conical coil tubes having a bottom with an opening formed therein, a chute disposed below the opening formed in the bottom of the supply container, reciprocating slider means including a transport compartment with an open top and bottom formed therein for dispensing single coil tubes through the opening formed in the bottom of the supply container into the chute, a feed station disposed below the chute for receiving unsorted conical coil tubes, means for successively slipping individual conical coil tubes onto spindles or creel mandrels of a textile machine, and controlled coil tube turning means for passing on a conical coil tube presented in unsorted condition at the feed station to the slipping on means with tips sorted.

27 Claims, 17 Drawing Figures

DEVICE FOR CHARGING A TEXTILE MACHINE WITH COIL TUBES

The invention relates to a device for loading a textile machine with individual conical coil tubes, consisting of (a) a supply container for the conical coil tubes, (b) a device for taking individual conical coil tubes from the supply container, and (c) a device for successively slipping individual conical coil tubes onto spindles or creel mandrels of the textile machine.

The term "coil tube" relates to empty, wound or partially wound coil forms, but primarily to empty conical coil tubes for use in a spinning frame.

The operating speed of the above mentioned devices is limited. In addition, they are disturbance-prone. It is an object of the invention to accelerate the loading of a textile machine with coil tubes and, especially, the loading of a spinning frame with empty conical coil tubes, and to make it operationally more reliable. This problem is solved by the invention by providing a device for dispensing a single coil tube through an opening in the bottom of the supply container into a chute by means of a reciprocating slider which has a transport compartment open at top and bottom, and a device for passing on a conical coil tube with tips sorted that was presented in unsorted condition at a feed station disposed at the lower end of the chute to the slipping-on device by means of a controlled coil tube turning device. One advantageous embodiment is wherein the coil tube turning device comprises a cross piece which is supported at a machine frame and can be swung back and forth by means of a controlled drive, a pair of gears which are rotatably supported on the cross piece and are formed of a sun wheel and a planetary gear which may, optionally, also have one or several intermediate gears, a locking device for locking the motion of the gears relative to the cross piece, a locking device for locking the sun wheel relative to the machine frame, and a coil tube holder connected to the planetary gear.

Since the device according to the invention performs two motion cycles, namely, the controlled turning of the coil tubes and passing them on, simultaneously, wherein the coil tube is always held fast and not left to itself, the operating speed can be increased as compared to conventional devices, while the proneness to disturbances is reduced.

In accordance with a further feature of the invention, the coil tube holder has a coil-tube suction nozzle subjected to underpressure.

In accordance with an added feature of the invention, the cross piece has an underpressure canal which is connected to the coil-tube suction nozzle.

In accordance with an additional feature of the invention, the cross piece has a hollow swing shaft which serves at the same time as the underpressure line.

In accordance with still another feature of the invention, the feed station comprises a coil tube sensing station which has an operative connection to the locking device for locking the sun wheel to the machine frame.

In accordance with still a further feature of the invention, the sensing device includes a controllable plunger, the position of which can be sensed by a feeler where the operational connection to the locking device starts at the feeler.

In accordance with still an added feature of the invention, the plunger is connected to an alternating drive through a buffered or cushioned control rod.

In accordance with still an additional feature of the invention, the coil tube holder cooperates with a controlled slip-on device which takes over and passes on the coil tube with tips sorted.

In accordance with yet another feature of the invention, the slip-on device has two gripping hooks which can be controlled by a drive, and at which a counter holder controllable by stops is supported so that it can be swung between the gripping hooks.

Advantageous embodiments of the supply container and the slider are provided as follows.

In accordance with yet a further feature of the invention, the bottom opening of the supply container is at least twice as wide as the transport compartment, and the slider has mechanical disturbance elements which are in contact beside the transport compartment with the lower layer of coil tubes of the supply container.

In accordance with yet an added feature of the invention, the disturbance elements are disposed in the form of a grid iron parallel to the longitudinal direction of the transport compartment.

In accordance with yet an additional feature of the invention, the disturbance elements are in the form of round rods.

In accordance with again another feature of the invention, the disturbance elements are in the form of rotatably supported cylinders.

In accordance with again a further feature of the invention, the slider has an intermittent drive with an elastically resilient force transmission element.

In accordance with again an added feature of the invention, the bottom of the supply container is inclined toward the bottom opening by an angle of eleven to fifteen degrees from the horizontal.

In accordance with again an additional feature of the invention, the supply container is detachably and exchangeably supported on a frame carrying the slider.

In accordance with another feature of the invention, the side walls of the supply container are trapezoidal, the wider side of the trapeze forming the upper edge.

In accordance with a further feature of the invention, stacking surfaces are provided on the inside below the upper edge for the purpose of stacking similar containers on top of one another.

The following advantages relate to the embodiment of the supply container according to the invention as a transport container.

In accordance with an added feature of the invention, the supply container for the conical coil tubes is designed as an exchangeable transport container with a bottom opening that can be closed off by a separate slider.

In accordance with an additional feature of the invention, the separate slider is supported in two slot-like cutouts in the side walls of the container, the separate slider protrudes from the two cutouts with one handle end at each side, and the material thickness of the separate slider including its handle ends is smaller than the width of the slot-like cutouts.

In accordance with yet another feature of the invention, the transport container and separate slider are connected to each other by means of an easily detachable detent device.

In accordance with yet a further feature of the invention, the bottom is inclined in the direction toward the bottom opening by an angle of 11 to 15 degrees from the horizontal.

Further advantageous embodiments of the overall loading device are described as follows In accordance with yet an added feature of the invention, the loading device is constructed so that it can be moved relative to the textile machine.

In accordance with yet an additional feature of the invention, the loading device comprises at least one initiator for ascertaining the position of a spindle or a slip-on mandrel of the textile machine and has an operative connection to the drive of the coil-tube slip-on device.

In accordance with again another feature of the invention, the device for taking individual coil tubes from the supply container, the device for passing-on a coil tube with tips sorted, and the coil tube slip-on device have a common drive motor.

In accordance with a concomitant feature of the invention, the drive motor is a controllable stepping motor.

In the following text, the invention will be described and explained in greater detail with the aid of an embodiment example shown in the drawings.

FIGS. 1*a* and 1*b* show a front and a side view of the loading device according to the invention.

Figure 9:
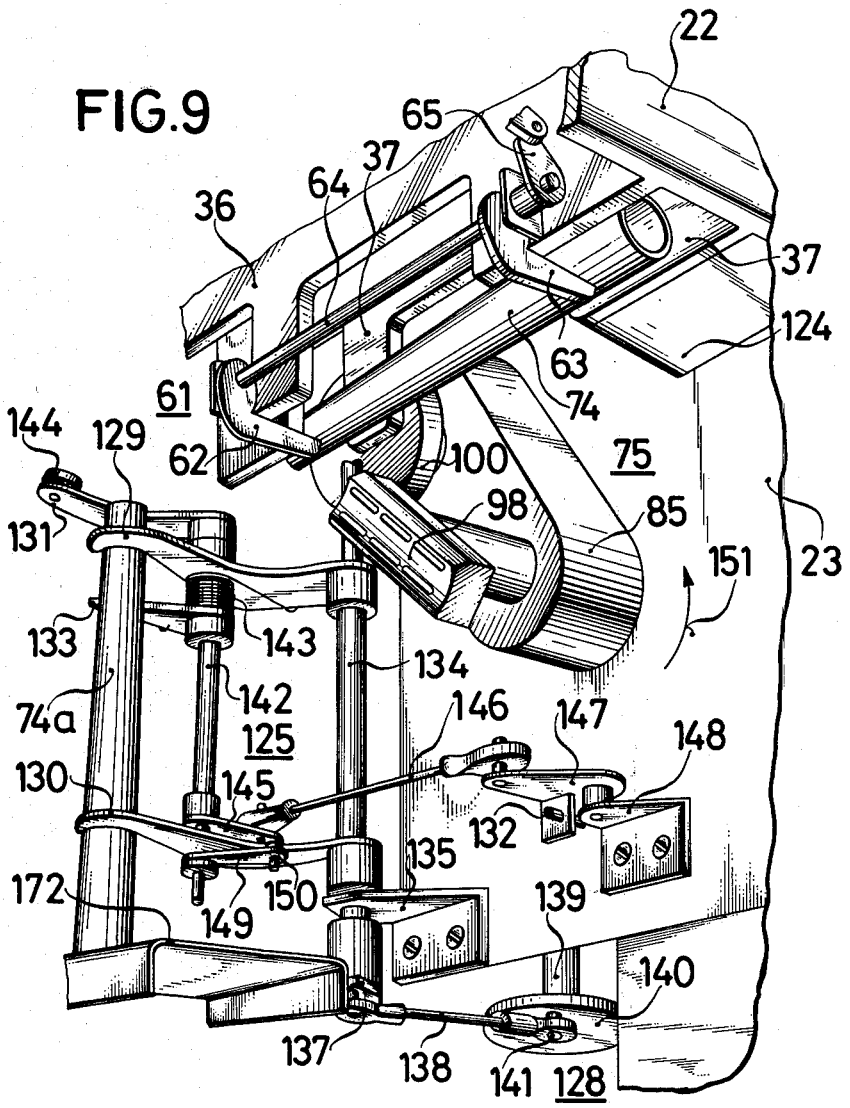
Figure 10:
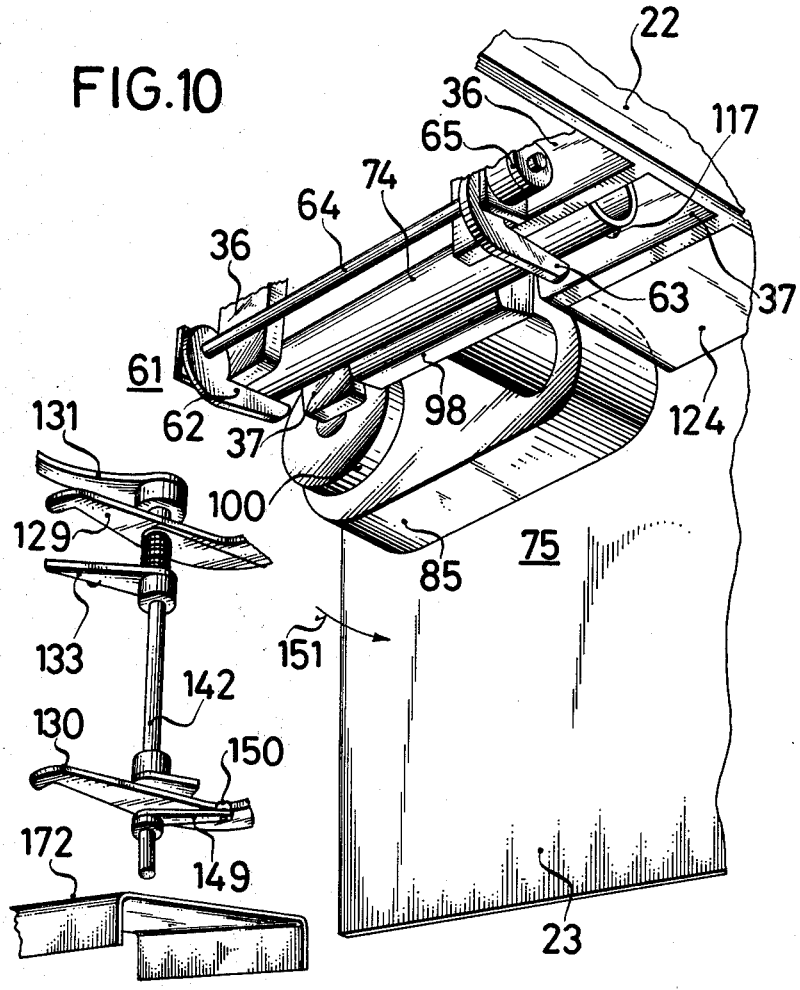
Figure 11:
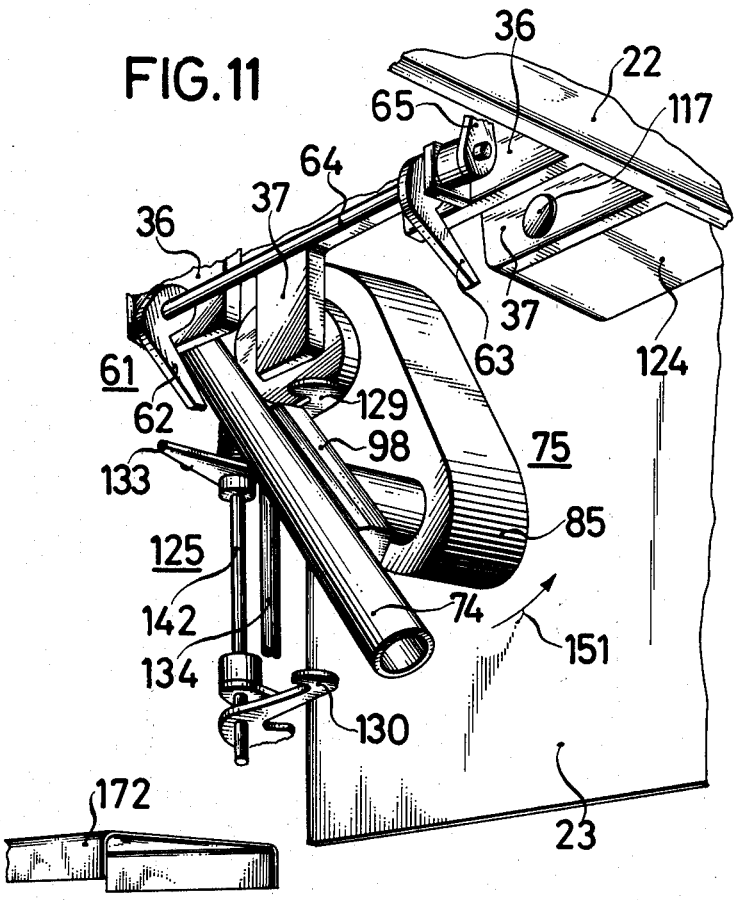

In FIGS. 9, 10 and 11, the turning operation and the passing-on of a conical coil tube is shown in three phases.

Figure 12:
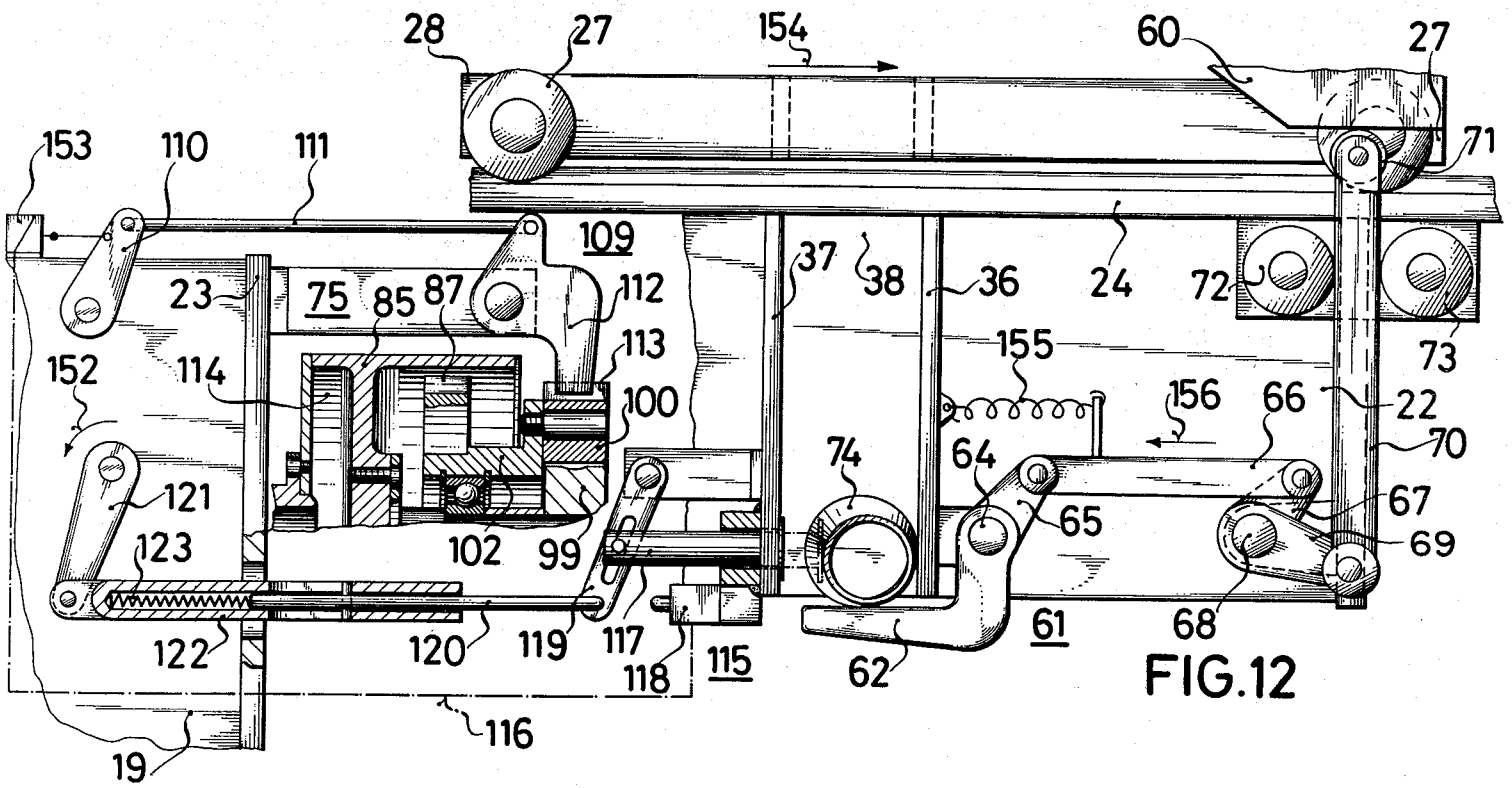
Figure 13:
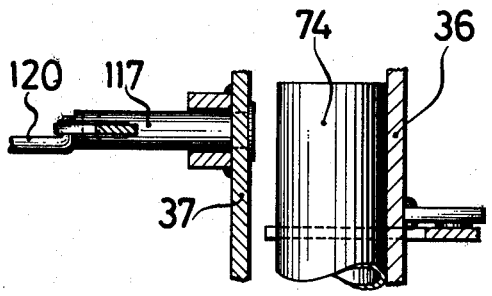

FIG. 12 shows details of a coil body sensing device, as does FIG. 13.

Figure 14:
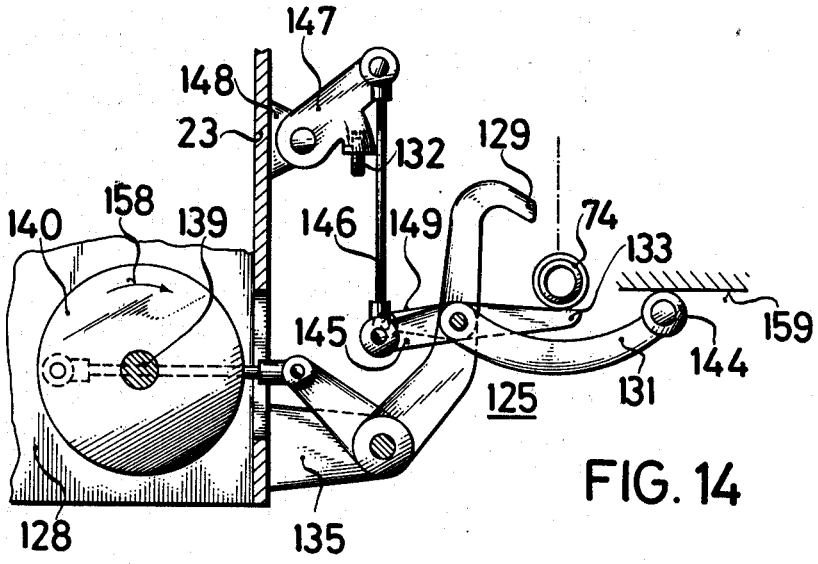
Figure 15:
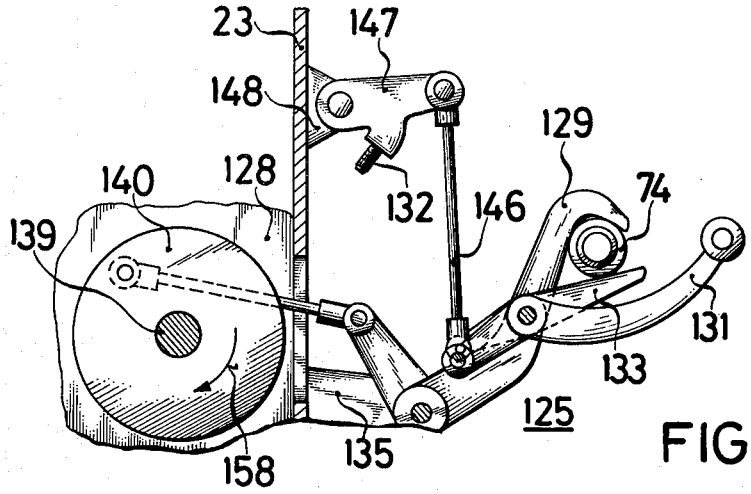
Figure 16:
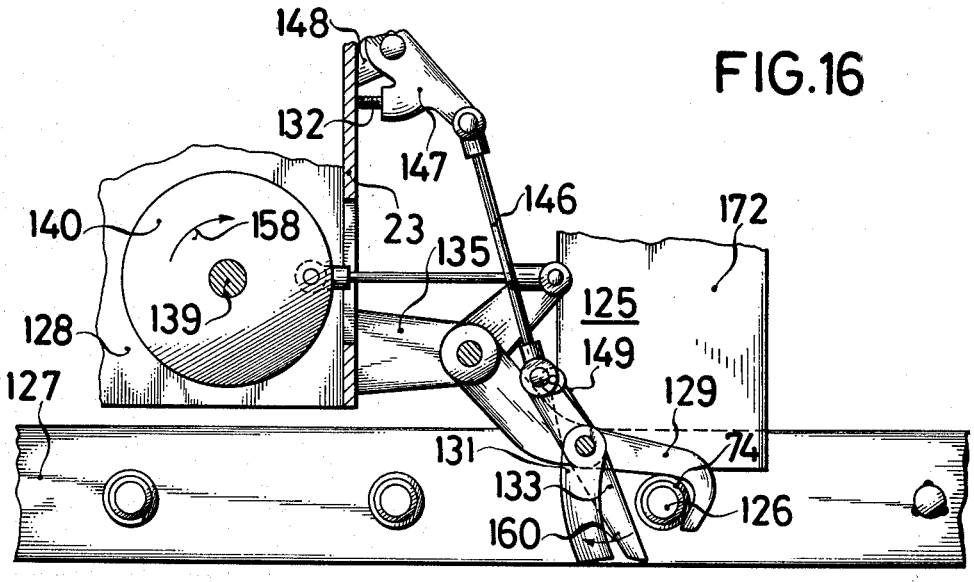

In FIGS. 14, 15 and 16, the motion cycle of the slip-on device is shown in three phases.

Figure 17:
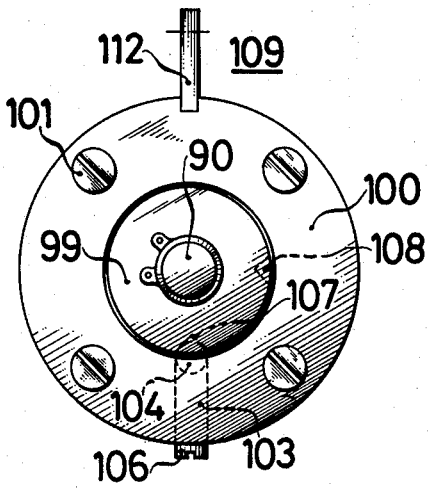

FIG. 17 shows details of the coil tube turning device.

Figure 1A:
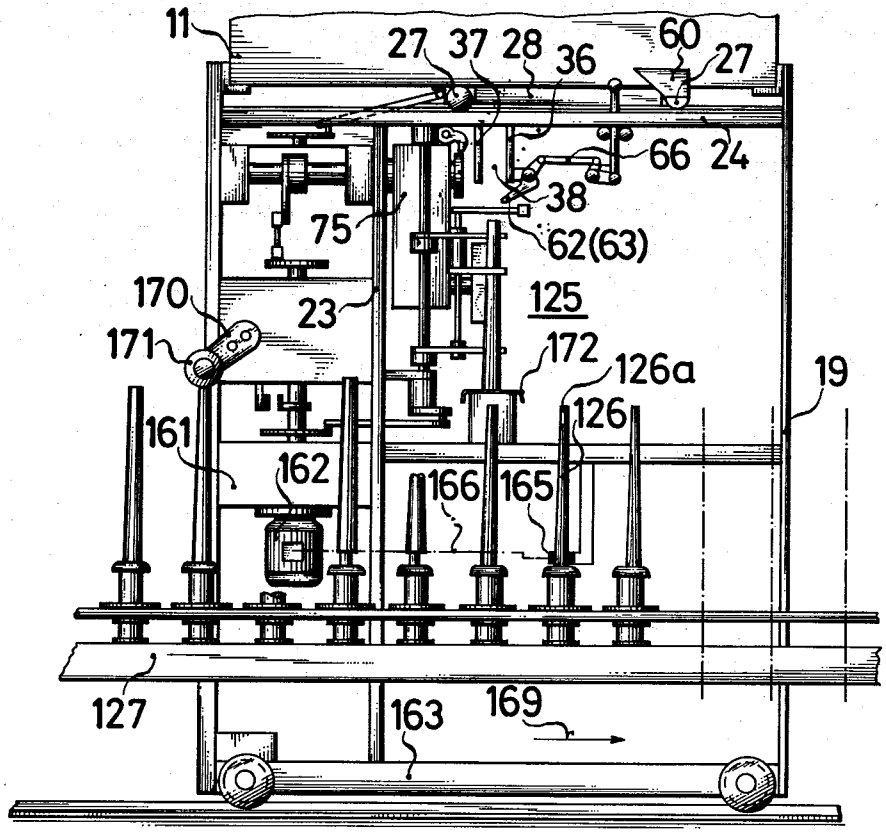
Figure 1B:
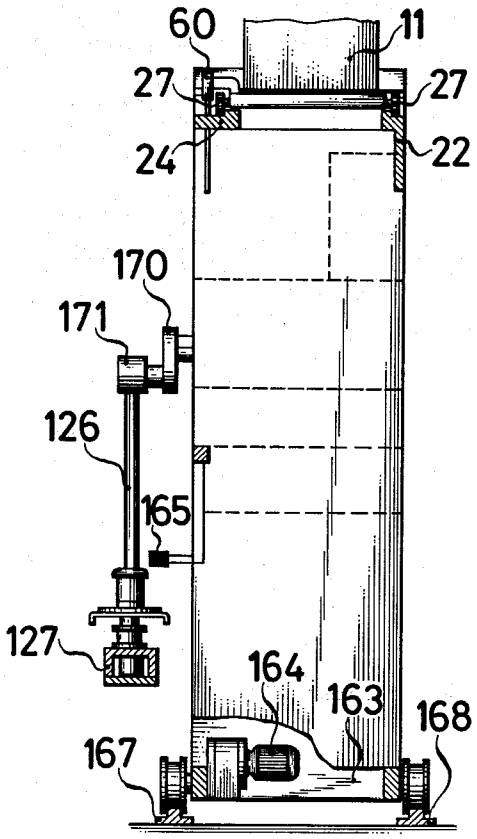

In FIGS. 1*a* and 1*b* can be seen the principal parts of which the device according to the invention consists, namely, the supply container 11 for the conical coil tubes; the device for taking individual conical coil tubes from the supply container 11, designed as a slider 28; the device 125 for successively slipping individual conical coil tubes onto spindles 126 of a spinning frame 127, not shown in all details; the device 75 to pass on, with tips sorted, a conical coil tube fed-in unsorted; the common drive 161 with the stepping motor 162; and the undercarriage 163 with the propulsion motor 164.

Figure 2:
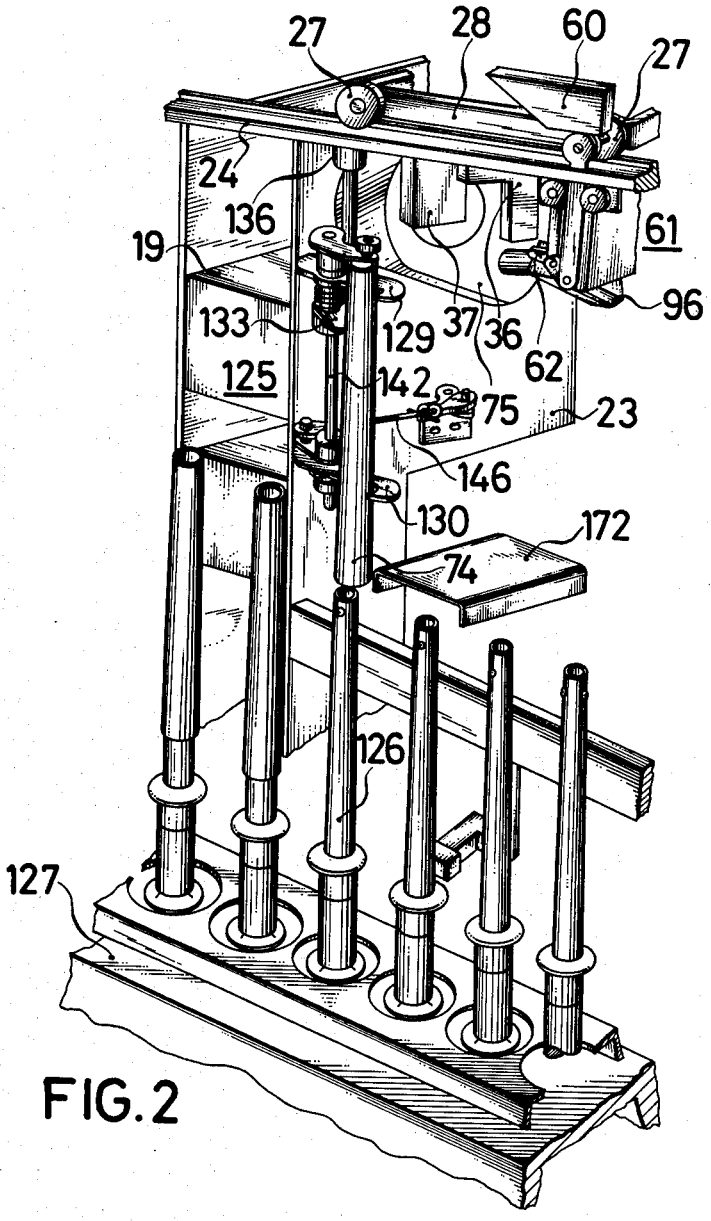
FIG. 2 shows a partial view.

As can be seen particularly in FIGS. 1*a*, 1*b* and 2, the machine frame 19 of the loading device according to the invention has a longitudinal wall 22, a partition 23, a lengthwise cross piece 24 and various transverse cross pieces. The upper edge of the longitudinal wall 22 and the longitudinal cross piece 24 serve as a track for the rollers 27 of a slider 28 which carries a control wedge 60. A feed station 61 is formed, as shown particularly in FIGS. 1*a* and 12, by two partitions 36, 37 of a chute 38 and two hinged coil support levers 62, 63, arranged underneath the chute. The two coil support levers are connected to each other by a common shaft 64. A flexible connection exists from the coil support lever 63 via a crank 65 to a strap 66, which is connected to a crank 67. The crank 67 is mounted at the end of a shaft 68, at the other end of which a crank 69 is likewise fastened. The crank 69 is linked to a control rod 70. A control roller 71 is mounted to the end of the control rod 70. The control rod 70 is guided laterally by two antifriction bearings 72, 73. As soon as the control wedge 60 of the slider 28 runs onto the control roller 71, as shown in FIG. 12, the two coil support levers 62, 63 are swung under the chute 38 and catch a conical coil tube 74 which drops through the chute from above.

Figure 3:
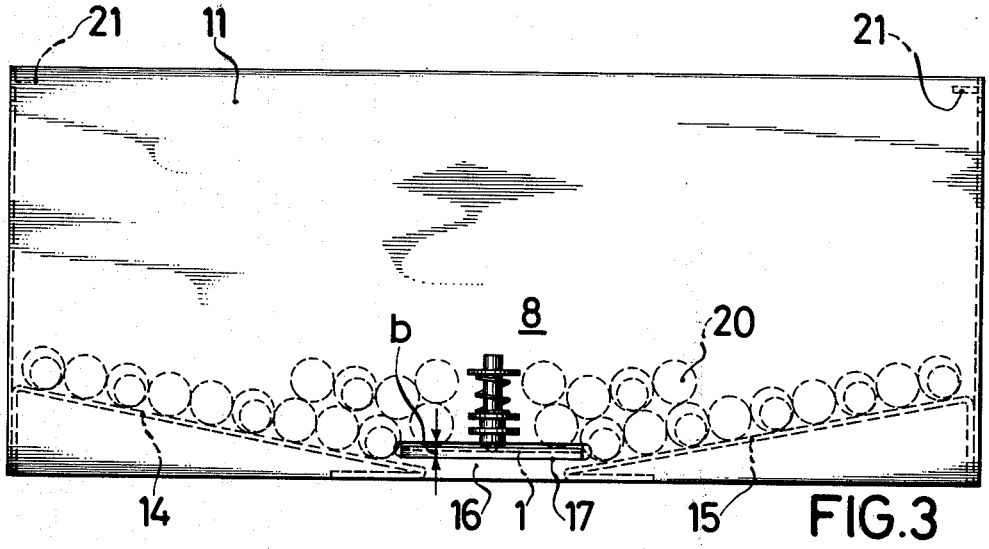
FIG. 3 shows a supply container designed as a transport container in a view onto a long side.
Figure 4:
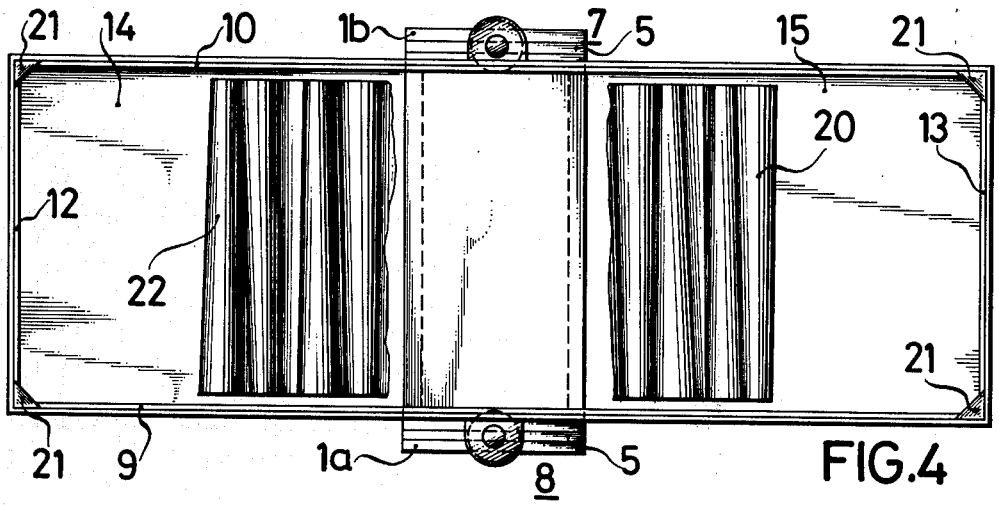
FIG. 4 shows a view from the top and FIG. 5 shows a view onto a small side.
Figure 5:
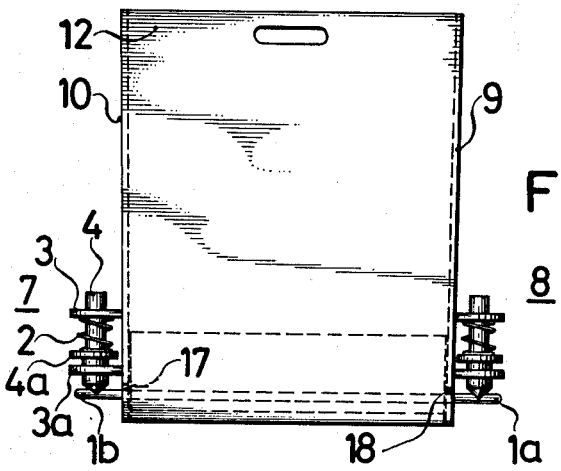

According to FIGS. 3, 4 and 5, the supply container 11 designed as an exchangeable transport container has two slightly trapezoidal side walls 9, 10 for the two longitudinal sides, two slightly trapezoidal side walls 12, 13 for the two small sides and a bottom which consists of the two bottom parts 14 and 15. The bottom parts 14 and 15 are arranged symmetrically and have in the direction toward a bottom opening 16 an inclination of 11 degrees from the horizontal. Just above the bottom opening 16, slot-like cutouts 17 for receiving a separate slider 1 can be seen in the side walls 9 and 10. The slider 1 protrudes with a handle end 1*a*, 1*b* from the two cutouts. The material thickness of the slider 1 including its handle ends is smaller than the width "b" (slot width) of the slot-like cutout 17.

The transport container and the slider are connected to each other by means of easily detachable detent devices 7, 8. Inside the transport container, conical coil tubes 20 are seen. These coil tubes lie parallel to the side walls 12, 13. Otherwise, the tips of the coil tubes are not oriented, i.e., it is left to chance whether the smaller cone end points toward the side wall 10 or toward the side wall 9.

In detail, each of the two detent devices 7, 8 consists of a notch 5 arranged in the handle end of the slider 1 and a detent pin 4 with a shoulder 4*a*. The detent pin 4 is guided in two brackets 3, 3*a* fastened to the side wall of the longitudinal side. A compression spring 2 loads the shoulder 4*a* of the detent pin 4 so that it sits in the notch 5 of the slider 1.

The compression spring 2 is made only weak, so that the slider 1 can easily be pulled out and equally easily reinserted into the cutouts 17, which is achieved by bevels at the slider and the detent pins.

Since the side walls are trapezoidal, the transport container is wider at the top than at the bottom, so that containers of the same kind can be nested. Stacking stops 21 arranged below the upper edge in the corners of the container prevent jamming and provide a defined stop. The new detent device provides an easily detachable form-fitting or positively force-transmitting locking and prevents unintentional pulling-out of the separate slider 1. The proposed inclination of the bottom facilitates emptying the transport container. Heretofore, the slider could be pulled out in known devices only to one side. Care always had to be taken that the handle end of slider came to lie on the operating side of the work station. It was a subtask of the invention to simplify the placement of the transport container at the work station, for instance, inasmuch as it is no longer necessary to see to it that the container points forward with a given front side and rearward with a given rear side. This objective was solved by the features of the slider 1 having cutouts 17 in the walls 9, 10, having handles 1*a*,*b* protruding from the cutouts 17 and having a thickness, even at the handles, which is smaller than the width b of the cutouts 17. Since then, the slider which closes off the bottom opening can be pulled out toward two sides, it is no longer necessary to pay attention to a given position of the side walls in the placing and transporting of the containers. Working with such transport containers is thereby simplified.

Figure 6:
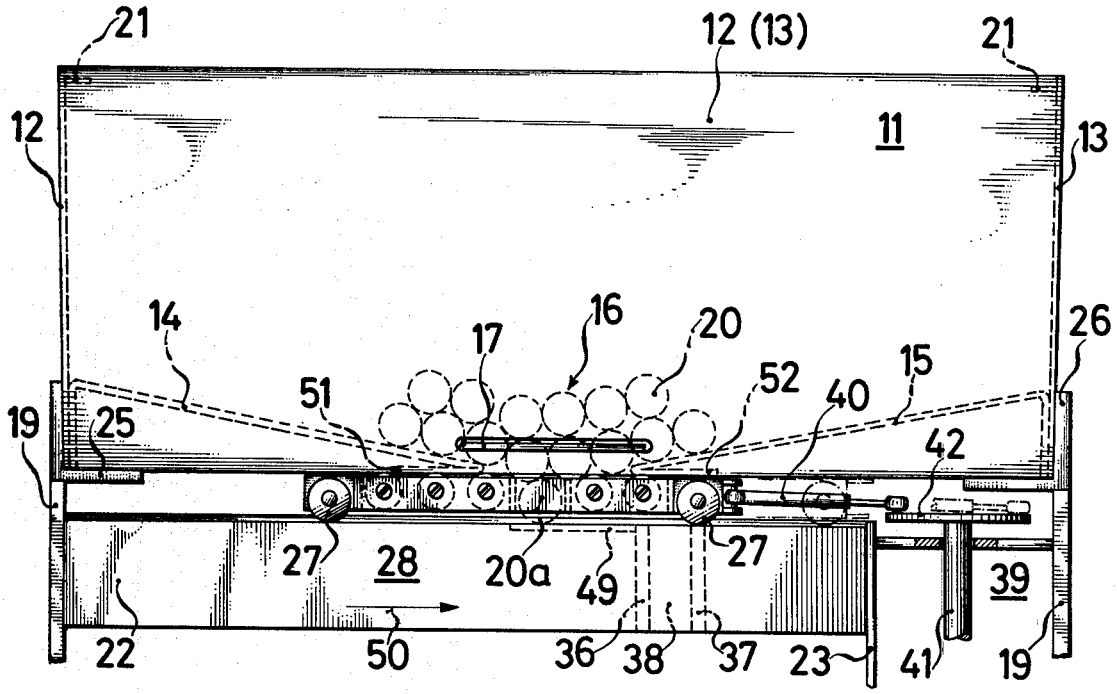
FIG. 6 shows a side view of the supply container according to the invention with the device for taking out individual conical coil tubes.
Figure 7:
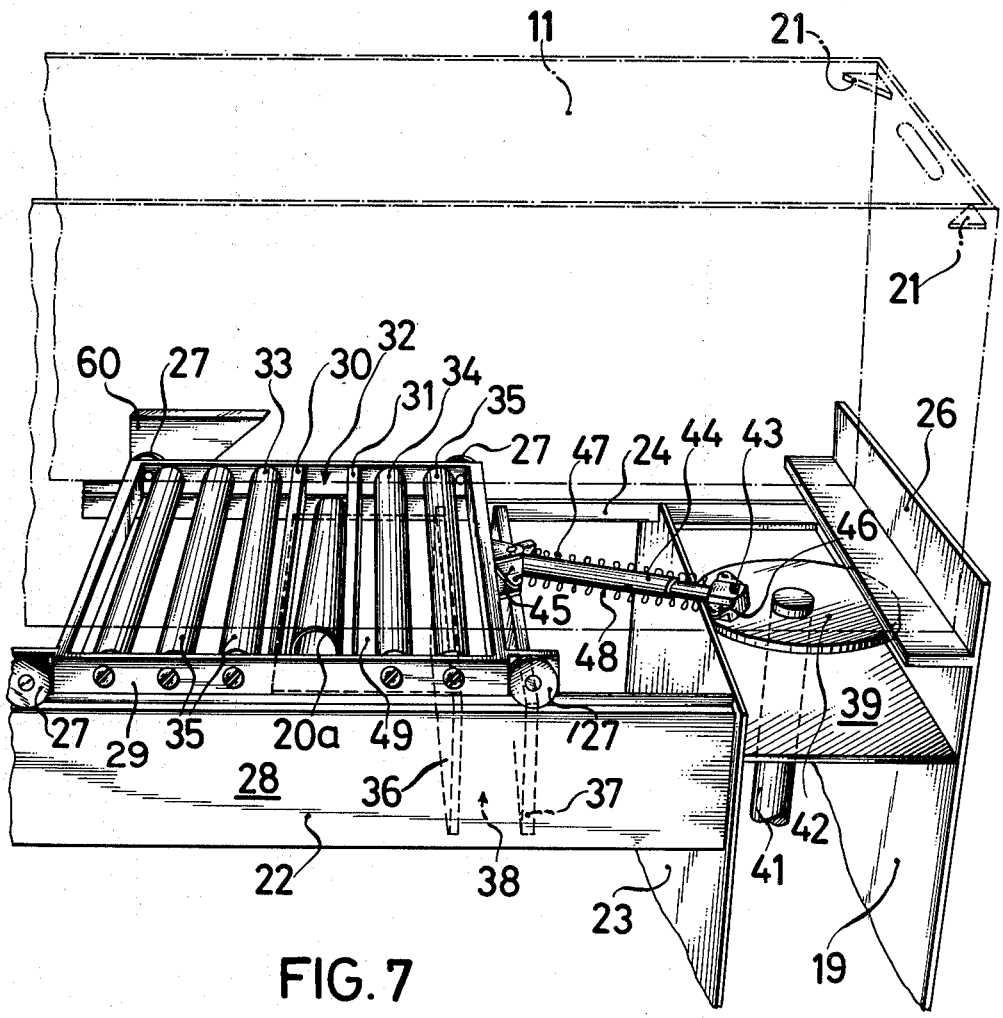
FIG. 7 shows the same device in a fractional perspective view.

According to FIGS. 6 and 7, the slider 28, which serves as the device for taking individual conical coil tubes from the supply container 11, consists of a rectangular frame 29; a coil tube transport compartment 32 which is located approximately in the middle, is open at the top and is formed by two partitions 30, 31; and several mechanical disturbance elements which are arranged in grid-iron-fashion parallel to the longitudinal direction of the transport compartment 32. The disturbance elements are cylinders 33, 34 which are arranged to the left and right of the transport compartment 32 and are supported rotatably in the frame 29, and three round rods 35 which have the same diameter as the cylinders. The disturbance elements are arranged side by side so that the coil tubes 20 stored in the supply container 11 can neither drop through the gaps between the disturbance elements, nor can they be jammed in these gaps. However, the spacings between these disturbance elements must not be too small either, otherwise their effect is diminished.

The drawing of FIG. 6 indicates that the bottom opening 16 of the supply container 11 is more than twice as wide as the transport compartment 32 of the slider 28. On the other hand, the chute 38 which is arranged between the longitudinal cross piece 24 and the longitudinal wall 22 and consists of the partitions 36 and 37, has the same width as the coil tube transport compartment 32.

The slider 28 has an intermittent drive 39 with an elastically resilient force-transmission element 40.

The drive 39 is connected to the common drive 161 shown in FIG. 1*a* and consists of a shaft 41 and a disc 42 fastened to the shaft, with a crankpin 43. The force-transmission element 40 consists of a telescoping tube 44 with a joint 45, 46 at each end, two tension springs 47, 48 and a compression spring which is located inside the telescoping tube 44. For each revolution of the shaft 41, the slider 28 goes back and forth once.

The drawings of FIGS. 6 and 7 show the slider 28 in the extreme left-hand position. A coil tube 20*a* already lies in the transport compartment 32 on a plate 49 which connects the longitudinal wall 22 to the longitudinal cross piece 24 and adjoins the partition 36. As soon as the slider 28 now moves in the direction of the arrow 50, the coil tube 20*a* is taken along, goes into the chute 38 and drops down. In the meantime, the disturbance elements touch the lower layer of coils of the transport container 11 resting on the angle-like cross pieces 25 and 26, conduct them into the gaps between the disturbance elements, lift them again, conduct them back into the gaps, and so forth. The motion of the lower layer of coils is also transmitted to the coil tubes above, so that the contents of the container are prevented from jamming or from forming bridges. It is seen that the two bottom parts 14 and 15 have horizontal angled-off portions 51, 52 which at the same time prevent a coil tube taken up by the transport compartment 32 from escaping toward the top.

The advantages obtained with the new device are, among others, that individual coil tubes can be taken out, without disturbance, at a rapid sequence. Should a foreign body get into the supply of coil tubes and block the slider, no secondary damage is done because the force-transmission element which drives the slider, is elastically resilient.

Figure 8:
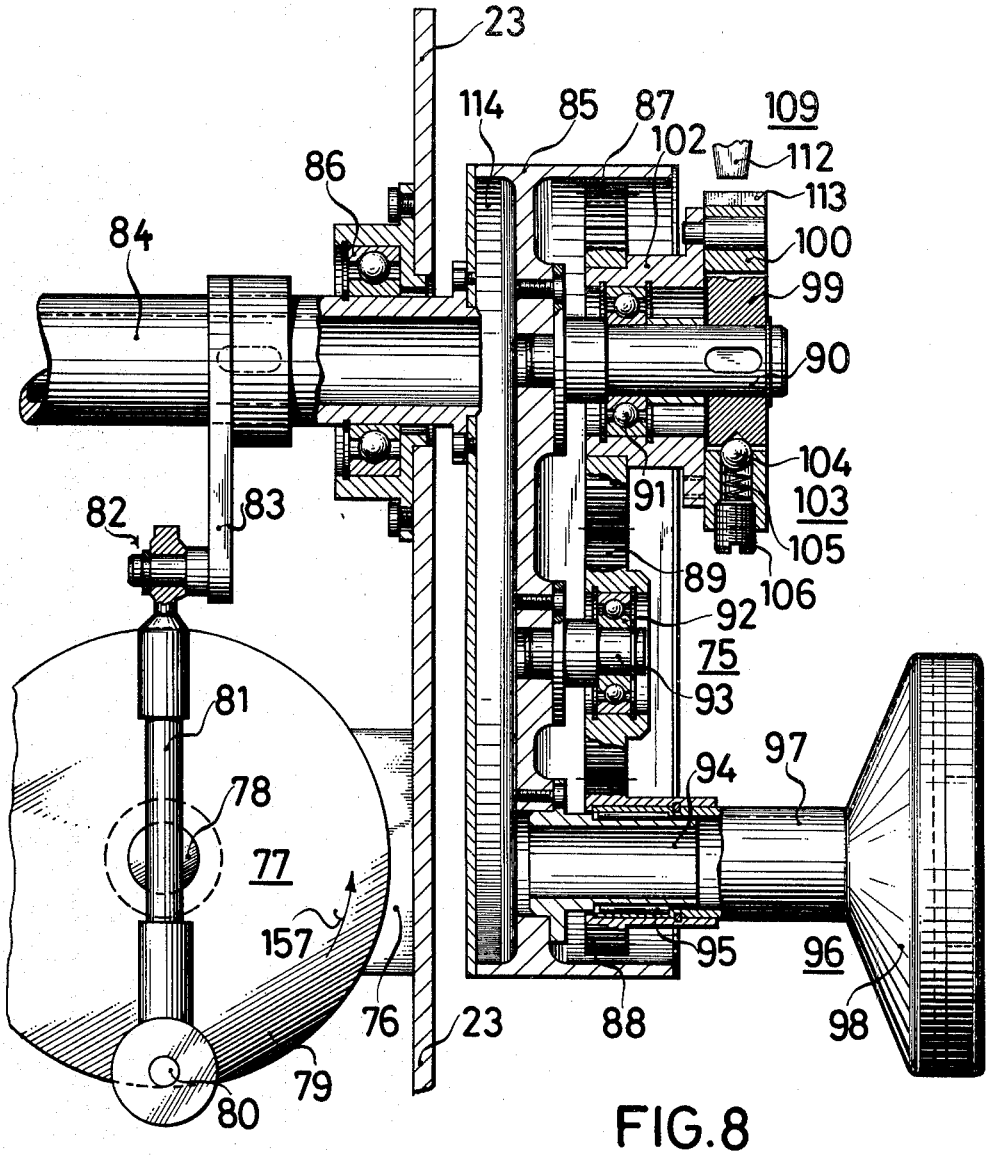
FIG. 8 shows a section through the coil tube turning device.

As is shown particularly in FIG. 8, a coil tube turning device, designated as a whole with 75, is supported in the partition 23 as the device for passing-on, with the tips sorted, a coil tube fed-in unsorted. The coil tube turning device 75 consists of the following parts:

In the partition 23 is supported by means of a cross piece 76 a controlled drive 77 which consists of a stepping motor, not shown, a disc 79 connected to the shaft 78 of the stepping motor, a crankpin 80 fastened to the disc, a connecting rod 81 and a joint 82. From the joint 82, a connection is made via a crank 83 to a hollow swinging shaft 84, to which a cross piece 85 is fastened. A ball bearing 86 connected to the partition 23 carries the swinging shaft 84 which serves at the same time as the underpressure line and makes it possible for the cross piece 85 to swing by an angle of 90 degrees. For greater clarity of presentation, the drive 77 is shown swung by 90 degrees into the plane of the drawing in FIG. 8.

Gears are rotatably supported on the cross piece 85, and specifically, a sun wheel 87, a planetary gear 88 and an intermediate gear 89. A pin 90 connected to the cross piece 85 carries a ball bearing 91 which in turn carries the sun wheel 87.

The intermediate gear 89 is supported on a pin 93 connected to the cross piece 85 with the interposition of a ball bearing 92. The planetary gear 88 has a special support arrangement. On a hollow shaft 94, a needle bearing 95 is arranged which carries the planetary gear 88. A coil tube holder 96 is connected to the planetary gear 88. It consists of a tube 97 with a coil tube suction nozzle 98.

As can be seen particularly from FIGS. 8 and 17, the pin 90 carries a ring 99. Over the ring 99, there is arranged, with a small spacing, a further ring 100 which is connected to the sun wheel 87 by four screws 101 by means of a bushing 102. The ring 100 carries a locking device 103 for blocking the relative motion of the gears against the cross piece 85. The locking device 103 consists of a ball 104, a compression spring 105 and a set screw 106. In the locked position, the ball 104 is detented in one of the two depressions 107, 108 in the ring 99. The two depressions are relatively shifted 90 degrees at the circumference of the ring 99. The depression 107 serves as a detent in the coil tube pickup position and the depression 108 as a detent in the coil tube discharge position of the coil tube turning device 75.

The herein aforementioned lock can be cancelled, specifically, by a further locking device 109 for locking the sun wheel 87 against the machine frame 19. This locking device is shown specifically in FIG. 12. It consists of a pawl 112 which can be controlled by a control lever 110, using a control rod 111. The ring 100 has a notch 113, in which the pawl 112 can detent in the respective coil tube pickup position of the coil tube turning device 75. The control for the detent will be discussed later on.

The drawings of FIG. 8 indicates that the cross piece 85 has an underpressure canal 114 which is connected to the coil tube suction nozzle 98. Therefore, a connection exists from the suction nozzle 98 via the hollow shaft 94, the underpressure canal 114 and the hollow swinging shaft 84 to an underpressure source, not specifically shown.

As can be seen particularly from the drawing of FIG. 12, the feed station 61 has a coil tube sensing device 115, from which an operative connection 116 leads to the locking device 109 for locking the sun wheel 87 against the machine frame 19. The sensing device 115 consists of a controllable plunger 117, the position of which can be sensed by a feeler 118; the operative connection 116 to the locking device 109 starts from the feeler 118. In the present embodiment example, the feeler 118 consists of a microswitch and the operative connection 116 is in the form of an electrical line. The plunger 117 is connected by means of a rocker arm 119 to an alternating drive 121 via a buffered control rod 120. The latter has a telescoping tube 122, in which a buffer spring 123 is provided. The plunger 117 extends with its end through the partition 37 into the chute 38 at the height of the waiting coil tube 74. The drawings of FIGS. 10 and 11, show that the coil tube sensing device 115 is mounted in a housing 124 attached to the partition 37.

The coil tube holder 96, and in a broader sense therefore also the coil tube turning device 75, cooperates with a device 125 for successively slipping individual conical coil tubes onto the spindles 127, which is designed as a controlled mechanical gripper which takes over and passes on the already tip-sorted coil tube 74 from the coil tube turning device 75 or its coil tube holder 96.

The slipping-on device 125, as shown in FIG. 9, has two gripping hooks 129, 130, which can be controlled by a drive 128 and at which a counter holder 133 controllable by stops 131, 132 is supported so that it can be swung between the gripping hooks 129,130. The latter are fastened to a vertical shaft 134. At the bottom, the shaft 134 is supported in a bracket 135 fastened to the partition 23 and at the top, to a bearing 136 fastened to the longitudinal cross piece 24. To the lower end of the shaft 134, a crank 137 is mounted which is connected by a connecting rod 138 to the drive 128. The drive 128 consists of a shaft 139, on which a disc is mounted which carries a crankpin 141. The shaft 139 is connected to the common drive 161 (FIG. 1*a*).

The gripping hooks 129,130 serve at the same time as support for a vertical shaft 142, to which the counter holder 133 is fastened. A coiled torsion spring 143 ensures that the counter holder 133 always tends to swing between the gripping hooks 129, 130. To the upper end of the shaft 142, the lever-like stop 131 is fastened which carries at its end a roller 144. The shaft 142 also has a crank 145 which is connected via a connecting rod 146 to a further crank 147 which carries the stop 132 in the form of an adjusting screw. The crank 147 is supported in a bracket 148 fastened to the partition 23. The herein aforementioned linkage is driven by the previously mentioned stepping motor. To limit the swing travel of the counter holder 133, the shaft 142 carries at its lower end a stop lever 149 with a roller 150. A table 172 serves for guiding the coil tube during the swinging motion or at least for preventing it from sliding down too far.

In the description which now follows of an operating cycle, a starting position according to FIG. 9 is assumed. The slipping-on device 125 had just before pulled a conical coil tube 74*a* off the coil tube suction nozzle 98, had been swung to the left and will drop the coil tube at the next instant. In the meantime, the cross piece 85 of the coil tube turning device 75 swings in the direction of the arrow 151 upward, i.e., counterclockwise to fetch the conical coil tube 74 which is already waiting at the feeding station 61.

In the meantime, the coil tube sensing device 115 according to FIG. 12 goes into action as follows:

The alternating drive 121 swings from the position shown 45 degrees in the direction of the arrow 152 and back. In the course of the swing motion, the plunger 117 makes contact with the coil tube 74. If it makes contact with the smaller end of the cone (with the plunger being indicated by dot-dash lines), then the rocker 119 switches on the sensor 118 and a current flows through the operative connection 116 to an electromagnetic actuator 153 operating the control lever 110. This makes the pawl 112 of the locking device 109 detent at the instant when the cross piece 85 is horizontal and the coil tube suction nozzle 98 is in the coil tube pickup position, as shown in FIG. 10. If the thinner end of the conical coil tube 74 were actually in front of the plunger 117, then the sun wheel 87 would be held by the pawl 112 when the cross piece 85 swings back against the direction of the arrow 151 as long as the swing motion of the cross piece 85 lasts, because the pawl 112 is self-locking. Since in the present embodiment example, the sun wheel 87 has twice as many teeth as the planetary gear 88 and an intermediate gear 89 is interposed, the coil tube suction nozzle 98 would rotate with the sucked-up coil tube 90 degrees in the opposite direction when the cross piece 85 swings back, i.e., in the direction of the arrow 151 if the cross piece 85 also executes a 90-degree rotation but against the direction of the arrow 151, while at the same time the locking device 103 disengages since it operates only with tensional connection. Thereby, the thinner end of the cone, which had previously been sensed by the coil tube sensing device 115, is on top at the end of the swing motion, as desired, and the thicker end would be at the bottom.

In the present embodiment example, however, it is provided that the thicker end of the cone of the coil tube 74 lies in front of the plunger 117, as shown particularly in FIG. 13. In that case, the rocker 119 has no occasion during the sensing process to actuate the feeler 118. The locking device 109 for locking the sun wheel 87 thus does not go into action in this embodiment example and the pawl 112 does not snap into the notch 113. Instead, the locking device 103 for blocking the relative motion of the gears against the cross piece remains detented and therefore, in operation. Accordingly, the following further procedure is obtained, starting from the position as per FIG. 10:

The suction air effective in the coil tube suction nozzle 98 sucks up the conical coil tube 74 and the drive 161 moves the slider 28 in the direction of the arrow 154 according to FIG. 12; a tension spring 155 pulling the strap 66 in the direction of the arrow 156 because the control roller 71 slides off the control wedge 60. As a result, the coil support levers 62 and 63 are hinged down. In the meantime, the slider 28 can take another coil tube from the supply container 11.

At the same time, the drive 77 is set in motion. The disc 79 rotates in the direction of the arrow 157 until the cross piece 85 occupies the position shown in FIG. 8, i.e., is vertical. According to FIG. 11, the cross piece 85 has not yet quite completed the swing motion against the direction of the arrow 151.

In the meantime, also the drive 128 becomes operative. The disc 140 make one-half revolution in the direction of the arrow 158 from the coil tube discharge position shown in FIG. 16. At the end of this motion, the slipping-on device 125 is in the coil tube pickup position as per FIG. 14. The stop 131 has run against a stop surface 159 and has swung the counter holder 133 back. The illustration of FIG. 11 shows that the slipping-on device 125 is already open before the coil tube turning device 75 has completed its motion. As soon as the coil tube 74 has been brought into the vertical position, as shown in FIG. 14, the disc 140 continues to rotate for half a revolution in the direction of the arrow 158. An intermediate position of this motion cycle is shown in FIG. 15. There, the coil tube is already clamped between the gripping hooks 129, 130 on the one side and the counter holder 133 on the other side. At the end of the motion of the disc 140, the slipping-on device 125 again assumes a position according to FIG. 16. The latter figure shows that the stop 132 has made contact with the partition 23 and the counter holder 133 has therefore been lifted off the coil tube in the direction of the arrow 160. The coil tube is then vertically above the spindle 126 of the spinning frame 127 and drops down onto the spindle.

The slipping-on device 125 remains in the end position shown in FIG. 16 until the initiator 165 shown in the drawings of FIGS. 1*a* and 1*b* has ascertained the approach of the next-following spindle 126*a*. Then it delivers via the operative connection 166 a start pulse to the drive 161, whereupon the motion cycle shown and described is repeated.

The coil tube turning device 75 is swung back already before the instant when the slipping-on device 125 has reached the position according to FIG. 15, to fetch the next-following coil tube. Since the slider 28 is moved in synchronism with the devices 75 and 125, coil tubes can be slipped onto the spindles of the spinning frame sequentially in this manner, while the complete loading device travels along the spinning frame 127 in the direction of the arrow 169 on the tracks 167, 168 without stopping.

FIG. 2 shows once more the final instant of passing-on the coil tube 74. It is clearly seen in FIG. 2 that the coil tube holder 96 has already been swung back far and can receive the next-following coil tube already shortly thereafter. It goes without saying that the motion cycles described must merge into one another. This calls for a well-tuned control system, which can be realized in a manner known per se by gears, crank drives or cams very simply. The drive 161 equipped with the electric stepping motor 162 has been found practical as a common drive element.

The invention is not limited to the embodiment example shown and described. The operative connection 116 can alternatively also be designed as a mechanical operative connection. This would have the advantage that all motion cycles can be started up from the central drive 161.

The travel velocity and the operating speed are matched to each other. The loading cycle is timewise adjusted always to a somewhat shorter theoretical value that the travel time required for the travel from spindle to spindle. A new loading operation is initiated only when the next spindle to be loaded has approached the initiator, so that in practice, the loading cycle and the travel cycle agree. Thus, if the loading device comes into the vicinity of a spindle of the spinning frame which is ready to receive one, it already has a coil tube ready for slipping-on.

The roller 171 which is visible in FIGS. 1*a* and 1*b* and is supported at an arm 170, has the purpose of pushing the conical coil tubes, which have already been slipped on, further down onto the spindles to a predetermined dimension. This can be accomplished simply by letting the roller roll off, or by swing motions of the arm 170. The further drives 39, 77, 121, 128 are centrally controlled by means of the central drive 161. Thus, all motions are tuned to each other. The tuning of the motion cycles is performed once empirically and then applies to other devices of the same kind. Gears, cams and control levers are known as adjusting elements for motion cycles, to name only a few elements.

We claim:

1. Device for loading a textile machine with individual conical coil tubes, comprising a supply container for the individual conical coil tubes having a bottom with an opening formed therein, a chute disposed below said opening formed in the bottom of said supply container, reciprocating slider means including a transport compartment with an open top and bottom formed therein for receiving single coil tubes dropped through said opening formed in the bottom of said supply container, transporting the single coil tubes horizontally and dropping the single coil tubes into said chute, a feed station disposed below said chute for receiving unsorted conical coil tubes, means for successively slipping individual conical coil tubes onto spindles or creel mandrels of a textile machine, and controlled coil tube turning means for passing on a conical coil tube presented in unsorted condition at said feed station to said slipping on means with tips sorted.

2. Device for loading a textile machine with individual conical coil tubes, comprising a supply container for the individual conical coil tubes having a bottom with an opening formed therein, a chute disposed below said opening formed in the bottom of said supply container, reciprocating slider means including a transport compartment with an open top and bottom formed therein for dispensing single coil tubes through said opening formed in the bottom of said supply container into said chute, a feed station disposed below said chute for receiving unsorted conical coil tubes, means for successively slipping individual conical coil tubes onto spindles or creel mandrels of a textile machine, controlled coil tube turning means for passing on a conical coil tube presented in unsorted condition at said feed station to said slipping on means with tips sorted, and a machine frame, said coil tube turning means comprising a cross piece supported in said machine frame, a controlled drive for swinging said cross piece back and forth, at least a sun gear and a planetary gear rotatably supported on said cross piece, means for locking movement of said gears relative to said cross piece, means for locking movement of said sun gear relative to the machine frame, and a coil tube holder connected to said planetary gear.

3. Device according to claim 2, including a coil-tube suction nozzle integral with said coil tube holder, and means for supplying underpressure to said suction nozzle.

4. Device according to claim 3, wherein said supplying means is an underpressure canal connected to said suction nozzle.

5. Device according to claim 3, wherein said supplying means is a hollow swing shaft integral with said cross piece.

6. Device according to claim 2, wherein said feed station comprises a coil tube sensing device operatively connected to said means for locking movement of said sun gear relative to the machine frame.

7. Device according to claim 6, wherein said sensing device includes a plunger for contacting a coil tube, and a feeler for said plunger connected to said means for locking movement of said sun gear relative to the machine frame.

8. Device according to claim 7, including an alternating drive and a cushioned control rod connected from said plunger to said alternating drive.

9. Device according to claim 2, including means for controlling said coil tube holder in accordance with the operation of said slipping on means.

10. Device according to claim 9, wherein said slipping on means includes two gripping hooks for a coil tube, a drive for said hooks, a counter holder for the coil tube swingably supported between said hooks, and stops for said counter holder.

11. Device according to claim 1, wherein said opening formed in the bottom of said supply container is at least twice as wide as said transport compartment, and said slider means include mechanical disturbance elements in contact with a lower layer of the coil tubes of said supply container alongside said transport compartment.

12. Device according to claim 11, wherein said disturbance elements are in the form of a grid iron disposed parallel to the longitudinal direction of said transport compartment.

13. Device according to claim 11 or 12, wherein said disturbance elements are in the form of round rods.

14. Device according to claim 11 or 12, wherein said disturbance elements are in the form of rotatably supported cylinders.

15. Device according to claim 11, including an intermittent drive for said slider means having an elastically resilient force transmission element.

16. Device according to claim 11, wherein the bottom of said supply container is downwardly inclined toward said opening formed therein at an angle of from 11 to 15 degrees from the horizontal.

17. Device according to claim 11, including a machine frame, and wherein said supply container is detachably and exchangeably supported on said machine frame and said slider means is carried by said machine frame.

18. Device according to claim 11, wherein said supply container has walls being trapezoidally shaped with the wider side of the trapezoid being at the upper edge of said walls.

19. Device according to claim 17 or 18, including stacking surfaces disposed inside said supply container below the upper edge thereof for stacking similar containers on top of each other.

20. Device according to claim 1, wherein said supply container is in the form of an exchangeable transport container, and including a separate slider for closing off said opening formed in the bottom thereof.

21. Device according to claim 20, wherein said transport container has two side walls and a slot-like cutout having a given width formed in each of said side walls, said separate slider being disposed in said cutouts, and including a handle end integral with separate slider protruding from each of said cutouts, said separate slider and handle ends having a smaller width than said given width.

22. Device according to claim 21, including a manually detachable detent device connecting said separate slider to said transport container.

23. Device according to claim 20 or 21, wherein the bottom of said supply container is downwardly inclined toward said opening formed therein at an angle of from 11 to 15 degrees from the horizontal.

24. Device according to claim 1, including means for providing movement relative to the textile machine.

25. Device according to claim 24, including a drive for said slipping on means, and an initiator operatively connected to said drive for ascertaining the position of a spindle or a mandrel and turning on said drive.

26. Device according to claim 1, including a common drive for said slider means, turning means and slipping on means.

27. Device according to claim 26, wherein said common drive is a controllable stepping motor.

* * * * *